US010399820B2

(12) United States Patent
Roberts et al.

(10) Patent No.: US 10,399,820 B2
(45) Date of Patent: Sep. 3, 2019

(54) ELEVATOR TENSION MEMBER STIFFNESS ESTIMATION AND MONITORING

(71) Applicant: Otis Elevator Company, Farmington, CT (US)

(72) Inventors: Randall Keith Roberts, Hebron, CT (US); YiSug Kwon, Farmington, CT (US); David Wayne Mckee, Somers, CT (US); Richard L. Hollowell, Georgetown, SC (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 4 days.

(21) Appl. No.: 15/119,522

(22) PCT Filed: Feb. 19, 2014

(86) PCT No.: PCT/US2014/017090
§ 371 (c)(1),
(2) Date: Aug. 17, 2016

(87) PCT Pub. No.: WO2015/126378
PCT Pub. Date: Aug. 27, 2015

(65) Prior Publication Data

US 2017/0008734 A1 Jan. 12, 2017

(51) Int. Cl.
*B66B 7/10* (2006.01)
*B66B 7/12* (2006.01)
*B66B 5/00* (2006.01)

(52) U.S. Cl.
CPC ..... *B66B 7/1215* (2013.01); *B66B 5/0018* (2013.01); *B66B 5/0031* (2013.01)

(58) Field of Classification Search
USPC ..... 187/393
See application file for complete search history.

(56) References Cited

U.S. PATENT DOCUMENTS 6,123,176 A * 9/2000 O'Donnell ..... B66B 7/1215 187/393
7,360,630 B2 * 4/2008 Brant ..... B66B 1/40 187/284

(Continued)

FOREIGN PATENT DOCUMENTS

CN 1951793 A 4/2007
JP 0597351 A 4/1993

(Continued)

OTHER PUBLICATIONS

Notification of Transmittal of the International Search Report and the Written Opinion of the International Searching Authority, or the Declaration; Application No. PCT/US2014/017090; dated Nov. 13, 2014; 12 pages.

(Continued)

*Primary Examiner* — Christopher Uhlir
(74) *Attorney, Agent, or Firm* — Cantor Colburn LLP

(57) ABSTRACT

A system for determining stiffness of an elevator system tension member includes a landing floor indicator to transmit a landing floor signal of an elevator car to a stiffness estimator, and a car position encoder to transmit a car position signal of the elevator car in a hoistway to the stiffness estimator. A machine position encoder transmits a machine position signal to the stiffness estimator. The tension member is operably connected to the machine to move the elevator car along the hoistway. A load weight sensor is located at the elevator car to transmit a load weight signal of the elevator car to the stiffness estimator. The stiffness estimator utilizes at least the landing floor signal, the car position signal, the machine position signal and the load weight signal to calculate an estimated stiffness of the tension member.

17 Claims, 5 Drawing Sheets

(56) References Cited

U.S. PATENT DOCUMENTS

| | | | | |
|---|---|---|---|---|
| 2005/0230192 | A1* | 10/2005 | Brant | B66B 1/40<br>187/284 |
| 2015/0008075 | A1* | 1/2015 | Benosman | B66B 7/06<br>187/247 |

FOREIGN PATENT DOCUMENTS

| | | | |
|---|---|---|---|
| JP | 0912245 | A | 1/1997 |
| JP | 09145504 | A | 6/1997 |
| JP | 2000007251 | A | 1/2000 |
| JP | 2001192183 | A | 7/2001 |
| JP | 2006027888 | A | 2/2006 |
| WO | 2009110907 | A1 | 9/2009 |
| WO | 2011147456 | A1 | 12/2011 |

OTHER PUBLICATIONS

Chinese Office Action Issued in CN Application No. 201480076006.5, dated Apr. 17, 2018, 8 Pages.

* cited by examiner

ELEVATOR TENSION MEMBER STIFFNESS ESTIMATION AND MONITORING

CROSS REFERENCE TO RELATED APPLICATIONS

This application is a National Phases Application of Patent Application PCT/US2014/017090 filed on Feb. 19, 2014, the entire contents of this application is incorporated herein by reference thereto.

BACKGROUND

The subject matter disclosed herein relates to elevator systems. More specifically, the subject disclosure relates to assessment of a stiffness of an elevator belt or rope.

Elevator systems typically include one or more tension members, for example, belts or ropes, to support and/or drive en elevator car or counterweight of the elevator system. The tension members are designed and manufactured to have an expected stiffness. The actual stiffness of the tension member often varies from the initial expected stiffness due to, for example, manufacturing variation or changes to or deterioration of the tension member structure over time after installation.

Changes in tension member stiffness or tension member stiffness that is different than expected may contribute to errors in position of an elevator car floor relative to a landing floor of the building during when landing at the landing or when there is passenger loading and unloading, especially in high-lift elevator systems. Such position errors increase the potential for passenger trip hazards.

BRIEF DESCRIPTION

In one embodiment, a method of calculating a stiffness of an elevator system tension member includes transmitting one or more elevator car position signals to a stiffness estimator. An estimated stiffness of the tension member is calculated using the transmitted signals.

Additionally or alternatively, in this or other embodiments the signals include a landing floor signal, a car position signal, a machine position signal and/or a load weight signal.

Additionally or alternatively, in this or other embodiments the car position signal and the load weight signal are utilized to calculate an actual effective length of the tension member.

Additionally or alternatively, in this or other embodiments the actual effective length is compared to a nominal effective length.

Additionally or alternatively, in this or other embodiments a difference between the actual effective length and the nominal effective length varies with load weight.

Additionally or alternatively, in this or other embodiments the difference between the actual effective length and the nominal effective length, and the load weight signal are utilized to determine the stiffness of the tension member.

Additionally or alternatively, in this or other embodiments a calculated stiffness is compared to a previously calculated stiffness.

Additionally or alternatively, in this or other embodiments a difference in calculated stiffness is indicative of wear or damage to the tension member.

In another embodiment, a system for determining stiffness of an elevator system tension member includes a landing floor indicator to transmit a landing floor signal of an elevator car to a stiffness estimator. The system further includes a car position encoder to transmit a car position signal of the elevator car in a hoistway to the stiffness estimator. A machine position encoder transmits a machine position signal to the stiffness estimator. The tension member is operably connected to the machine to move the elevator car along the hoistway. A load weight sensor positioned at the elevator car transmits a load weight signal of the elevator car to the stiffness estimator. The stiffness estimator utilizes at least the landing floor signal, the car position signal, the machine position signal and the load weight signal to calculate an estimated stiffness of the tension member.

Additionally or alternatively, in this or other embodiments the stiffness estimator is a computer.

Additionally or alternatively, in this or other embodiments the tension member is one of a rope or belt.

Additionally or alternatively, in this or other embodiments the car position signal and the load weight signal are utilized to calculate an actual effective length of the tension member.

Additionally or alternatively, in this or other embodiments the actual effective length is compared to a nominal effective length.

Additionally or alternatively, in this or other embodiments a difference between the actual effective length and the nominal effective length varies with load weight.

Additionally or alternatively, in this or other embodiments the difference between the actual effective length and the nominal effective length, and the load weight signal are utilized to determine the stiffness of the tension member.

Additionally or alternatively, in this or other embodiments a calculated stiffness is compared to a previously calculated stiffness.

Additionally or alternatively, in this or other embodiments a difference in calculated stiffness is indicative of wear or damage to the tension member.

The detailed description explains the invention, together with advantages and features, by way of examples with reference to the drawings.

DETAILED DESCRIPTION

Figure 1A:
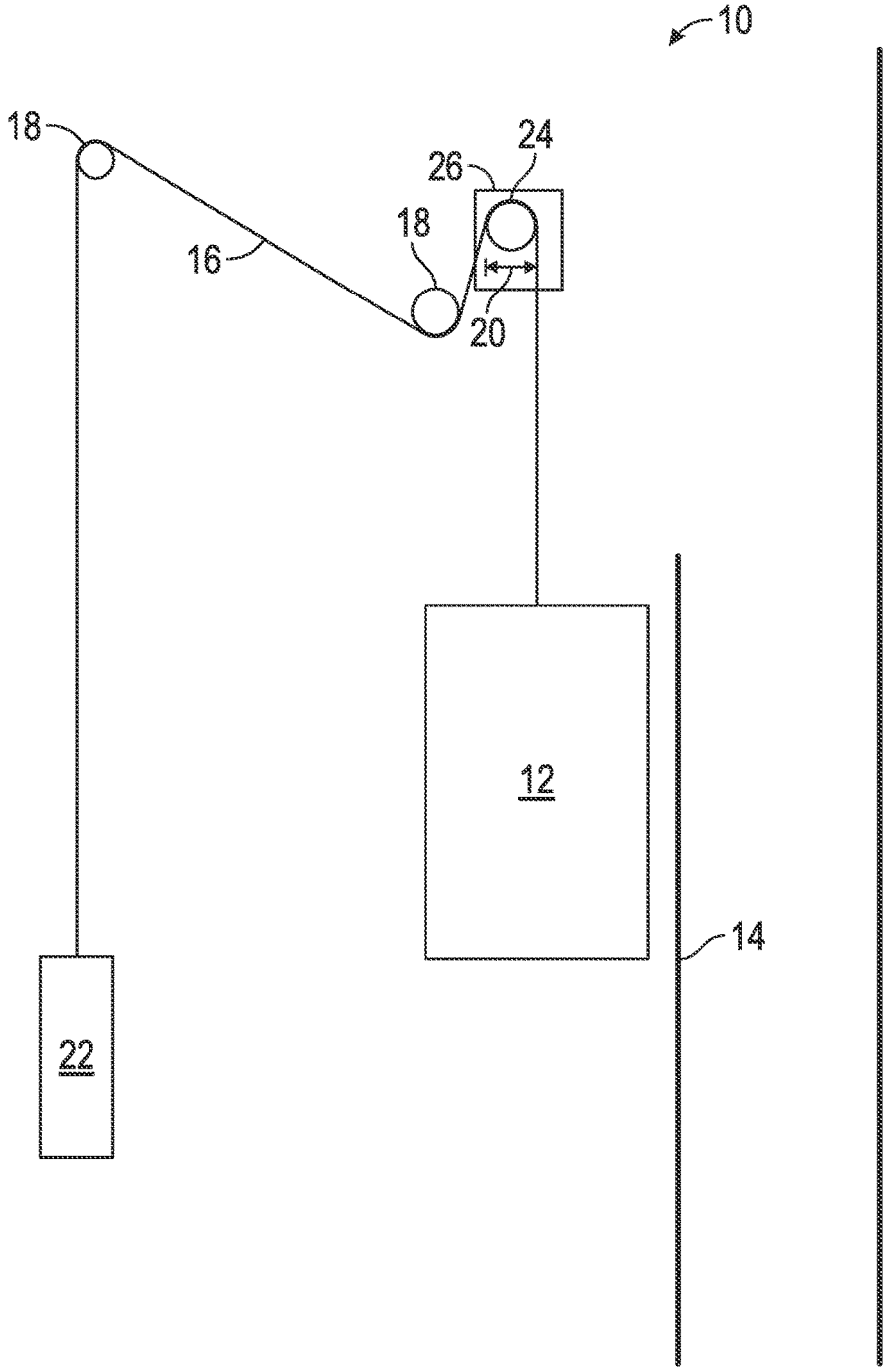
FIG. 1A is a schematic of an exemplary elevator system having a 1:1 roping arrangement.
Figure 1B:
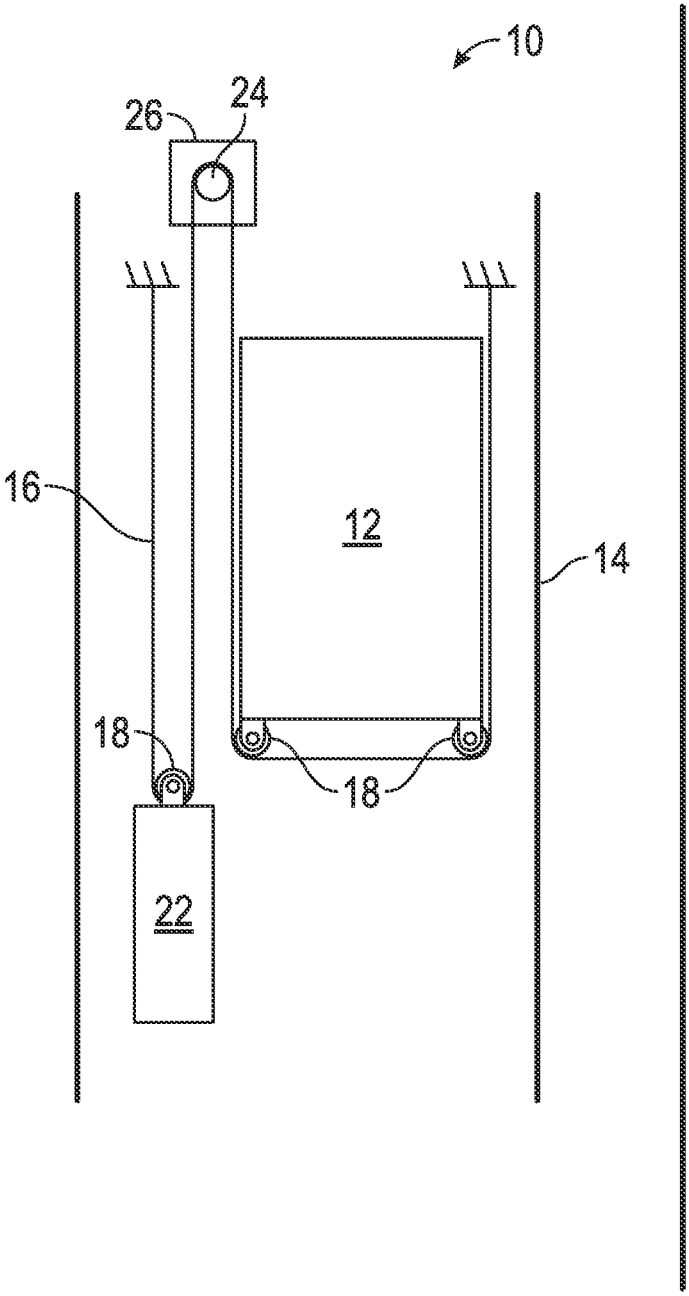
FIG. 1B is a schematic of another exemplary elevator system having a different roping arrangement.
Figure 1C:
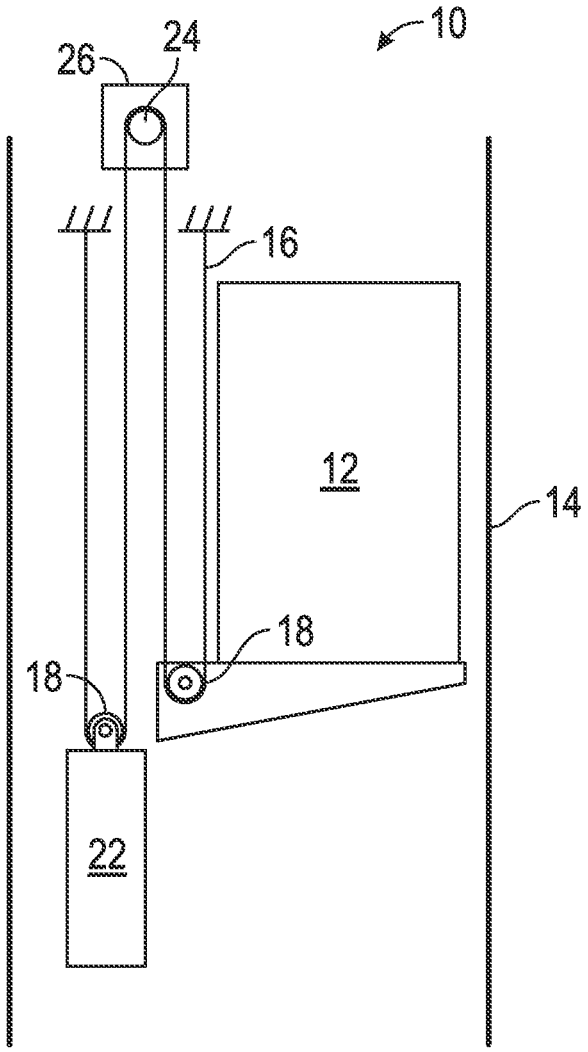
FIG. 1C is a schematic of another exemplary elevator system having a cantilevered arrangement.

Shown in FIGS. 1A, 1B and 1C are schematics of exemplary traction elevator systems 10. Features of the elevator system 10 that are not required for an understanding of the present invention (such as the guide rails, safeties, etc.) are not discussed herein. The elevator system 10 includes an elevator car 12 operatively suspended or supported in a hoistway 14 with one or more tension members 16. The tension member 16 may be, for example a rope of a coated steel belt. The one or more tension members 16 interact with one or more sheaves 18 to be routed around various components of the elevator system 10. The one or more tension members 16 could also be connected to a counterweight 22, which is used to help balance the elevator system 10 and reduce the difference in belt tension on both sides of a traction sheave 24 during operation.

The traction sheave 24 is driven by a machine 26. Movement of the traction sheave 24 by the machine 26 drives, moves and/or propels (through traction) the one or tension members 16 that are routed around the traction sheave 24.

In some embodiments, the elevator system 10 could use two or more tension members 16 for suspending and/or driving the elevator car 12. In addition, the elevator system 10 could have various configurations such that either both sides of the one or more tension members 16 engage the one or more sheaves 18 (such as shown in the exemplary elevator systems in FIG. 1A, 1B or 1C) or only one side of the one or more tension members 16 engages the one or more sheaves 18. In addition, the elevator system 10 can use two or more elevator cars 12 aligned vertically in a multi-deck configuration connected together by a cab frame. FIG. 1A provides a 1:1 roping arrangement in which the one or more tension members 16 terminate at the car 12 and counterweight 22. FIGS. 1B and 1C provide different roping arrangements. Specifically, FIGS. 1B and 1C show that the car 12 and/or the counterweight 22 can have one or more sheaves 18 thereon engaging the one or more tension members 16 and the one or more tension members 16 can terminate elsewhere, typically at a structure within the hoistway 14 (such as for a machine roomless elevator system) or within the machine room (for elevator systems utilizing a machine room). The number of sheaves 18 used in the arrangement determines the specific roping ratio (e.g., the 2:1 roping ratio shown in FIGS. 1B and 1C or a different ratio). FIG. 1C also provides a cantilevered type elevator. The present invention could be used on elevator systems other than the exemplary types shown in FIGS. 1A, 1B and 1C.

Figure 2:
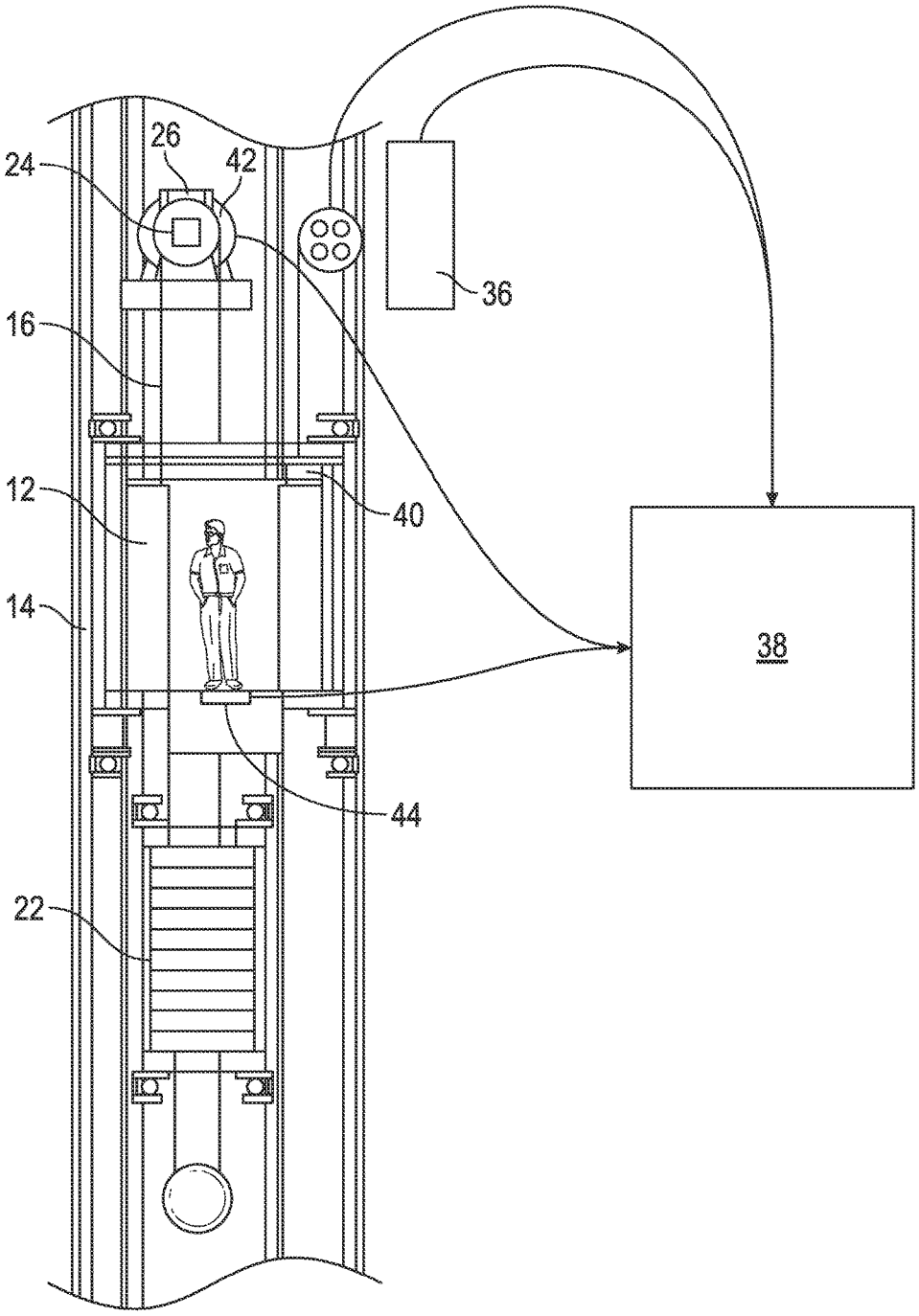
FIG. 2 is a schematic of a stiffness estimation system for an elevator system.
Figure 3:
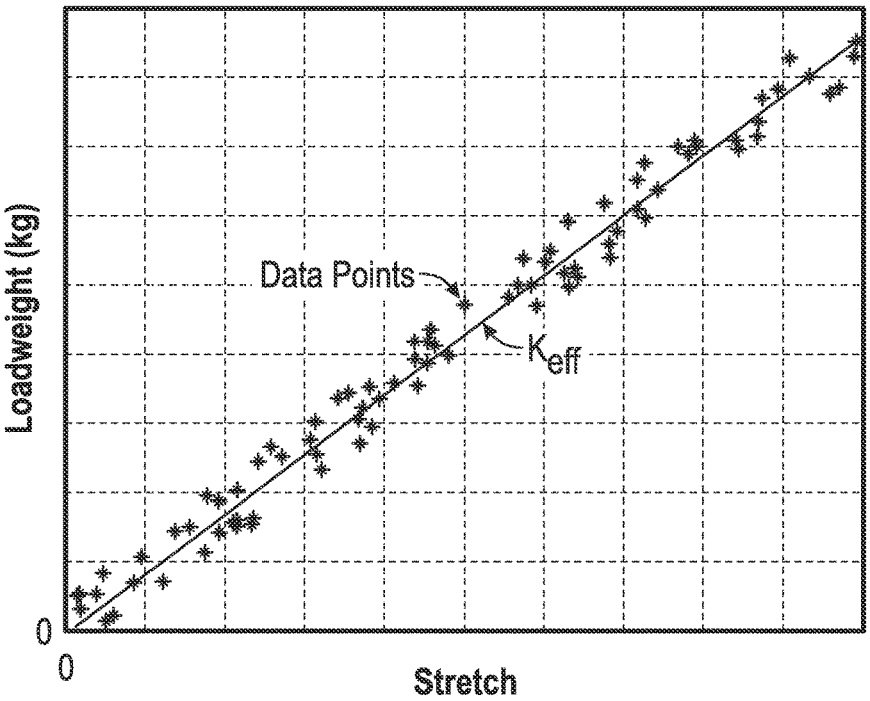
FIG. 3 is a graphic illustration of variation of effective tension member length versus load weight.

Referring now to FIG. 2, a schematic of a tension member stiffness estimating system is illustrated. As shown the elevator car 12 is supported in the hoistway 14 by the tension member 16. The tension member 16 is connected to the machine 26, which is fixed in the hoistway 14. The hoistway 14 includes a number of landing floors 36 at which the elevator car 12 may stop along its travel. A modulus estimator, for example, a computer 38 is operably connected to the elevator system 10. When the elevator car 12 stops at a selected landing floor 36, the computer 38 receives signals from components of the system 10 to compute an estimated modulus of elasticity of the tension member 16. These signals include identification of which landing floor 36 the elevator car 12 is stopped at, and a car position signal provided by, for example, a car encoder 40. Further, a machine position is provided to the computer 38 via a machine encoder 42. Finally a load weighing signal is provided to the computer 38 from a load weight sensor 44 at the elevator car 12. The load weighing signals are recorded in time as the elevator car 12 unloads and loads at the landing floor 36. The car position and machine position are used by the computer to calculate the actual effective stretch of tension member 16 as a function of time during the loading and unloading at the landing floor. The stretch (S) of the tension member, and varies with load weight, as collected via the load weight sensor 44 and communicated to the computer 38, shown in FIG. 3. The effective total stiffness (Keff) estimated from the slope of the collected measured load versus measured stretch (S) for service provided at a specific landing floor 36.

With such data collected at a single landing floor 36 location, and with various load weights, a linear regression analysis is performed to estimate an effective stiffness ($K_{eff}$) at this particular landing floor 36 as a slope of the line resulting from the regression analysis.

Figure 4:
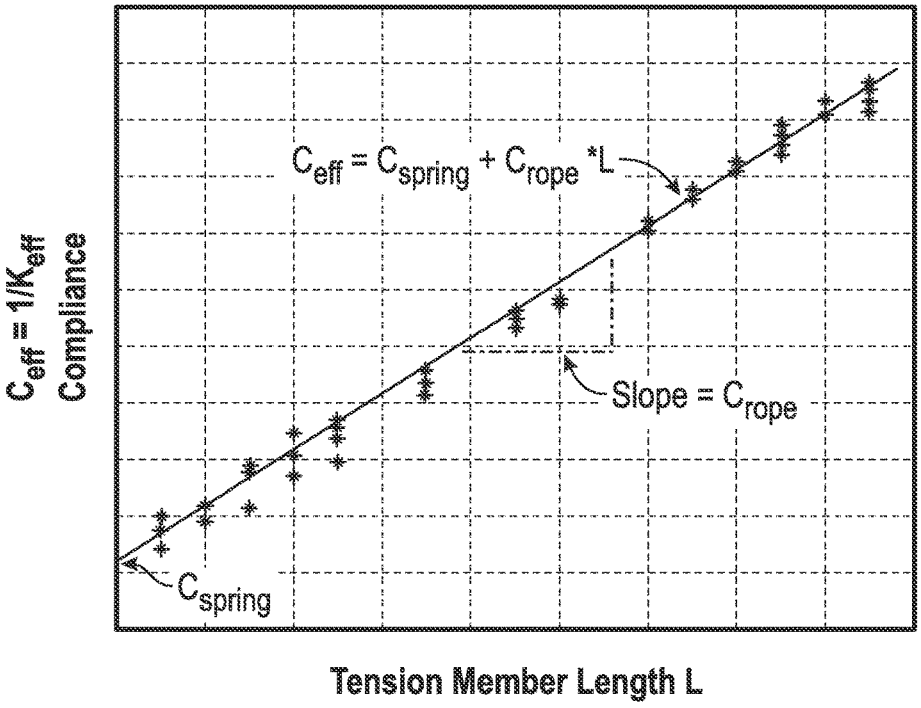
FIG. 4 is a graphic illustration of tension member compliance versus length of the tension member.

In most elevator systems 10 there are additional springs in series with the tension members, such as hitch springs or platform springs that can contribute to the effective stiffness ($K_{eff}$) at a given landing. This additional spring rate can be estimated by recording the car encoder 40, machine encoder 42, and load weight sensor 44 readings at multiple landing floors 36 and using resultant effective stiffness estimate as a function of the tension member lengths at the measured landing floors 36 as shown in FIG. 4. A regression analysis can be performed on the landing compliance ($C_{eff}$) values, which are the inverse of the estimated stiffness values ($1/K_{eff}$), as a function of the rope length. A linear relationship is expected for fit this data well of the form predicted in equation 1 below:

$$C_{eff}=C_{spring}+C_{rope}L \quad (1)$$

Where this linear fit intersects the zero length value is an estimate of the compliance of any fixed springs in the system ($C_{spring}$). The linear slope($C_{rope}$). is an estimate of the rope compliance per unit tension member length. An effective tension member modulus (E) of a single rope or belt can then be predicted as shown in equation 2 below:

$$E=1/(nA\ C_{rope}) \quad (2)$$

Where n equals a number of ropes in the tension member 16; and A is an effective cross-sectional area of a single tension member 16.

Data is collected and a modulus history is accumulated and evaluated as health monitoring of the tension member 16. Reduced modulus over time can indicate wear or breakage of the tension member 16, at which time the tension member 16 may be repaired or replaced. Further, modulus and stretch data gathered can be used to introduce correction factors into algorithms utilized for landing and releveling operations of the elevator car 12. Further still, collected data can be used to compare hoistway to hoistway, car to car, if desired. Changes in tension member stiffness over time can also be used predict their remaining useful life. This invention can be used as a critical component in an automated tension member life management system.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A method of calculating a stiffness of an elevator system tension member comprising:

stopping an elevator car of the elevator system at a selected landing floor;

loading and/or unloading the elevator car at the selected landing floor;

transmitting one or more elevator car position signals to a stiffness estimator;

transmitting one or more machine position signals of an elevator system machine to the stiffness estimator;

transmitting one or more load weight signals of the elevator car to the stiffness estimator;

calculating a stretch of the tension member as a function of time during the loading and/or unloading of the elevator car; and determining an effective total stiffness of the tension member as a slope of the transmitted one or more load weight signals versus the stretch.

2. The method of claim 1, wherein the car position signal and the one or more load weight signals are utilized to calculate an actual effective length of the tension member.

3. The method of claim 2, wherein the actual effective length is compared to a nominal effective length.

4. The method of claim 3, wherein a difference between the actual effective length and the nominal effective length varies with load weight.

5. The method of claim 4, wherein the difference between the actual effective length and the nominal effective length, and the one or more load weight signals are utilized to determine the stiffness of the tension member.

6. The method claim 1, further comprising comparing a calculated stiffness to a previously calculated stiffness.

7. The method of claim 6, wherein a difference in calculated stiffness is indicative of wear or damage to the tension member.

8. A system for determining stiffness of an elevator system tension member comprising:

a landing floor indicator to transmit a landing floor signal of an elevator car to a stiffness estimator;

a car position encoder to transmit a car position signal of the elevator car in a hoistway to the stiffness estimator;

a machine position encoder to transmit a machine position signal of a machine to the stiffness estimator, the tension member operably connected to the machine to move the elevator car along the hoistway; and a load weight sensor disposed at the elevator car to transmit one or more load weight signals of the elevator car to the stiffness estimator;

wherein the stiffness estimator utilizes at least the landing floor signal, the car position signal, the machine position signal and the one or more load weight signals, wherein the one or more load weight signals are collected during loading and/or unloading of the elevator car at a selected landing floor to calculate an estimated stiffness of the tension member by:

calculating a stretch of the tension member as a function of time during the loading and/or unloading of the elevator car; and determining an effective total stiffness of the tension member as a slope of the one or more load weight signals versus the stretch.

9. The system of claim 8, wherein the stiffness estimator is a computer.

10. The system of claim 8, wherein the tension member is one of a rope or belt.

11. The system of claim 8, wherein the car position signal and the one or more load weight signals are utilized to calculate an actual effective length of the tension member.

12. The system of claim 11, wherein the actual effective length is compared to a nominal effective length.

13. The system of claim 12, wherein a difference between the actual effective length and the nominal effective length varies with load weight.

14. The system of claim 13, wherein the difference between the actual effective length and the nominal effective length, and the one or more load weight signals are utilized to determine the stiffness of the tension member.

15. The system of claim 8, further comprising comparing a calculated stiffness to a previously calculated stiffness.

16. The system of claim 15, wherein a difference in calculated stiffness is indicative of wear or damage to the tension member.

17. The method of claim 1, comprising:

moving the elevator car to a first selected landing floor location;

determining a first effective total stiffness of the tension member as the slope of the transmitted one or more load weight signals versus the stretch at the first selected landing floor location;

moving the elevator car to a second selected landing floor location;

determining a second effective total stiffness of the tension member as the slope of the transmitted one or more load weight signals versus the stretch at the second selected landing floor location; and comparing the first effective total stiffness to the second effective total stiffness.

* * * * *